US011014799B2

(12) United States Patent
Mueller et al.

(10) Patent No.: US 11,014,799 B2
(45) Date of Patent: May 25, 2021

(54) DEVICE AND METHOD FOR FILLING A CONTAINER WITH A STERILISED FILLING PRODUCT

(71) Applicant: KRONES AG, Neutraubling (DE)

(72) Inventors: Holger Mueller, Neutraubling (DE); Juergen Soellner, Neutraubling (DE); Sebastian Baumgartner, Neutraubling (DE); Josef Doblinger, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 16/490,448

(22) PCT Filed: Mar. 1, 2018

(86) PCT No.: PCT/EP2018/055058
§ 371 (c)(1),
(2) Date: Aug. 30, 2019

(87) PCT Pub. No.: WO2018/158373
PCT Pub. Date: Sep. 7, 2018

(65) Prior Publication Data

US 2020/0017344 A1 Jan. 16, 2020

(30) Foreign Application Priority Data

Mar. 1, 2017 (DE) ..... 10 2017 104 313.6

(51) Int. Cl.
*B67C 3/28* (2006.01)
*B67C 7/00* (2006.01)
(Continued)

(52) U.S. Cl.
CPC ..... *B67C 3/286* (2013.01); *B67C 3/001* (2013.01); *B67C 7/00* (2013.01); *B67C 2003/226* (2013.01); *B67C 2003/228* (2013.01)

(58) Field of Classification Search
CPC ..... B67C 3/286; B67C 3/001; B67C 7/00; B67C 2003/226; B67C 2003/228;
(Continued)

(56) References Cited

U.S. PATENT DOCUMENTS 4,637,438 A * 1/1987 Weiss ..... B67C 3/10 141/39
6,035,872 A * 3/2000 Hees ..... B67C 3/001 134/167 R
(Continued)

FOREIGN PATENT DOCUMENTS

CN 104903229 A 9/2015
CN 105073626 A 11/2015
(Continued)

OTHER PUBLICATIONS

JPH-11310297-A English Translation of Specification (Year: 2020).*
(Continued)

*Primary Examiner* — Timothy P. Kelly
*Assistant Examiner* — Stephanie A Shrieves
(74) *Attorney, Agent, or Firm* — Maschoff Brennan

(57) ABSTRACT

A device for filling a container with a sterilized filling product, preferably for filling a beverage container with a sterilized beverage in a beverage bottling installation, comprising a sterilization device for sterilizing the filling product, a sterile tank for buffered receiving of the filling product sterilized in the sterilization device, and a filling device which has a filling valve for the filling of the container to be filled, wherein the filling valve is a proportional valve for controlling and/or regulating the filling-product flow of the filling product into the container to be filled, and the proportional valve is connected in a buffer-free manner to the sterile tank.

18 Claims, 2 Drawing Sheets

(51) Int. Cl.
*B67C 3/00* (2006.01)
*B67C 3/22* (2006.01)

(58) Field of Classification Search
CPC .... B67C 3/02; B67C 3/28; B67C 3/00; B65B 55/02; B65B 55/04; B65B 55/06; B65B 55/08; B65B 55/10; B65B 55/106
USPC ..... 141/92
See application file for complete search history.

(56) References Cited

U.S. PATENT DOCUMENTS

| | | | | |
|---|---|---|---|---|
| 2011/0303322 | A1* | 12/2011 | Clusserath | B67C 3/286 141/8 |
| 2014/0286822 | A1* | 9/2014 | Hayakawa | B08B 9/027 422/1 |
| 2014/0318670 | A1* | 10/2014 | Meinzinger | B67C 3/208 141/37 |
| 2014/0377444 | A1* | 12/2014 | Tanzosh | A23B 7/155 426/599 |
| 2015/0291406 | A1* | 10/2015 | Hayakawa | B67C 7/0073 422/3 |
| 2015/0375981 | A1* | 12/2015 | Knieling | F16L 58/10 141/144 |
| 2016/0016773 | A1* | 1/2016 | Angerer | B67C 3/007 141/1 |
| 2016/0046475 | A1* | 2/2016 | Hayakawa | B08B 3/02 134/22.18 |

FOREIGN PATENT DOCUMENTS

| | | | | | |
|---|---|---|---|---|---|
| CN | 105270661 | A | | 1/2016 | |
| DE | 2848988 | A1 | * | 5/1980 | B67C 3/06 |
| EP | 2939974 | A1 | | 11/2015 | |
| EP | 2975486 | A2 | | 1/2016 | |
| JP | S-5674485 | A | * | 6/1981 | B65B 3/04 |
| JP | H-11310297 | A | * | 11/1999 | |
| JP | H11310297 | A | | 11/1999 | |
| JP | 2002337988 | A | | 11/2002 | |
| JP | 5920433 | B2 | * | 5/2016 | A61L 2/04 |
| WO | WO-2010098231 | A1 | * | 9/2010 | B67C 3/04 |
| WO | 2010112143 | A2 | | 10/2010 | |

OTHER PUBLICATIONS

DE-2848988-A1 English Translation of Specification (Year: 2020).*
JP-5920433-B2 English Translation of Specification (Year: 2020).*
JPS-5674485-A English Translation of Specification (Year: 2021).*
WO-2010098231-A1 English Translation of Specification (Year: 2021).*
Office Action received in Chinese Application No. 201880028931.9, dated Nov. 6, 2020.

* cited by examiner

DEVICE AND METHOD FOR FILLING A CONTAINER WITH A STERILISED FILLING PRODUCT

TECHNICAL FIELD

The present invention relates to a device for filling a container with a sterilized filling product, in particular for filling a beverage container with a sterilized filling product in a beverage bottling installation.

TECHNICAL BACKGROUND

In beverage bottling installations, it is known to sterilize beverages prior to the actual bottling in the respective containers, in order to improve the shelf life thereof or in order to make it possible for the beverage to be reliably packed in beverage containers in the first place.

Sterilization of the filling product is to be understood here as meaning that the filling product is treated such that, after the sterilization, there are no longer any bacteria capable of reproduction in the filling product. In particular, it is to be understood as meaning that, with regard to the respective filling product, product-damaging bacteria are absent or can no longer reproduce. In other words, a sterilized filling product is to be understood as meaning a filling product which has a reliable absence of pathogenic and toxin-producing microorganisms, and an absence of further microorganisms and enzymes which, under normal conditions of handling, would cause the product to deteriorate in an unreliable manner.

In part, the term "sterile" is used synonymously with aseptic in the food industry, wherein however, in terms of its pure definition, aseptic refers to the absolute absence of microorganisms and spores. In the present case, the term "sterile" is still accordingly also to be understood as meaning an aseptic manifestation of the respective filling product.

For the purpose of sterilizing the respective filling product, it is known for example to sterilize the filling product physically, in particular thermally, or chemically prior to the bottling. In the case of physical sterilization, a thermal sterilization is known in which the filling product is heated, for example through the use of a heat exchanger, and is then kept at a predefined target temperature for a defined period of time, in order to obtain the desired biological safety of the filling product by way of the corresponding heat treatment. Besides said heat treatment of the filling product, physical sterilization processes which kill bacteria by UV irradiation or plasma treatment are for example also known.

Known as a chemical sterilization process is for example treatment with chemical sterilization means, for example with hydrogen peroxide, peracetic acid, chlorine dioxide or ozone. However, it is usually the case that the chemical sterilization is used only for the treatment of installation components or of the packing means and not, on the other hand, for the sterilization of the filling product itself, so as not to change the taste properties of the filling product.

Known in the case of heat treatment is in particular short-time heating (STH), in which the filling product is treated at a temperature above a product-related reference temperature for a predefined time so as to achieve the corresponding microbiological safety. Use is made of short-time heating installations as a biosafety stage for example in breweries for the bottling of beer, wherein the short-term heating installation is adjoined by a buffer tank, which is also referred to as a sterile tank and which makes it possible for the filling product to be buffered between the short-time heating installation and the actual filling device so as to allow intermediate storage of sterilized filling product in the case of variations in the removal thereof by the filling device.

For the bottling of non-alcoholic refreshment beverages or fruit juices, the short-term heating serves for the attainment of the required biological shelf life of the respective filling products. Here, provision is likewise made of a buffer tank between the short-term heating installation and the filling device so as to allow intermediate storage of sterilized filling product in the case of variations in the removal thereof by the filling device.

The buffer tank between the short-term heating installation and the actual filling device is necessary for ensuring a continuous filling-product flow through the heat exchanger of the short-term heating installation even if a fault occurs at the filling device. Otherwise, the dwell time of the filling product within the heat exchanger of the short-term heating installation would vary in a manner dependent on the instantaneous removal by the filling device arranged downstream. This could result in the dwell time of the filling product in the short-time heating installation possibly becoming too long, which can then lead to deterioration of the filling product, for example a change in taste.

In the filling device, for example a filler carousel, the filling product is then intermediately buffered again in a filling-product boiler, which is usually operated in a pressureless manner, and is then passed via individual filling valves to the container which is to be filled in each case. Here, use is made for example of a volumetric filling system, which requires that the filling-product boiler of the filler is operated in a pressureless manner in order to ensure the filling accuracy of the volumetric filling system. Accordingly, the filling product which is under pressure in the buffer tank of the short-time heating installation has to be transferred in a pressureless manner to the filling-product boiler of the filling device. Consequently, it is necessary for the buffer tank of the short-time heating installation to be decoupled from the filling-product boiler in order then for pressureless bottling from the filling-product boiler to be possible accordingly.

Said decoupling of the buffer tank of the short-time heating installation from the filling-product boiler of the filling device leads to the corresponding media, for example compressed air, nitrogen, $CO_2$ and steam, and cleaning, disinfection and sterilization media required for a cleaning, disinfection and sterilization process, having to be supplied twice. On the one hand, the media are supplied to the sterilization device and accordingly to the short-time heating installation and to the buffer tank arranged downstream, and on the other hand, the media are supplied to the filling device and to the filling-product boiler.

PRESENTATION OF THE INVENTION

Taking the known prior art as a starting point, it is an object of the present invention to specify a device for filling containers with a sterile filling product that has an improved construction. Advantageous refinements emerge from the independent claims, the present description and the figures.

Accordingly, a device for filling a container with a sterilized filling product, preferably for filling a beverage container with a sterilized beverage in a beverage bottling installation, which device comprises a sterilization device for sterilizing the filling product, a sterile tank for buffered receiving of the filling product sterilized in the sterilization device, and a filling device which has a filling valve for the filling of the container to be filled, is proposed. According to the invention, the filling valve is a proportional valve for controlling and/or regulating the filling-product flow of the filling product into the container to be filled, and the proportional valve is connected in a buffer-free manner to the sterile tank.

The fact that the filling product is transferred in a buffer-free manner from the sterile tank to a proportional valve for controlling and/or regulating the filling-product flow into the container to be filled means that the system can be continuously operated in a buffer-free manner from the sterile tank of the sterilization device to the container to be bottled and in particular also under the pressure prevailing in the sterilization device. Decoupling of the sterilization device from the filling device is therefore no longer necessary, and the installation can altogether be of simpler and more compact construction.

At the same time, reliable bottling of a predefined quantity of sterilized filling product in the container is possible. This is possible since, by means of the proportional valve, corresponding pressure variations or pressure differences during the provision of the filling product can be compensated such that it is still possible for reliable filling of the container with the desired filling-product quantity, in particular the desired filling-product volume, the desired filling-product weight or the desired filling-product filling level within the container, to be achieved.

A proportional valve is to be understood herein as meaning that the filling valve which controls and/or regulates the filling-product flow into the respective individual container can be operated not only in an open and a closed switching position but also in at least one further switching position therebetween, in which a filling-product flow which is reduced in comparison with the fully open switching position is attained. Accordingly, the filling-product flow which passes through the proportional valve can be varied by means of the corresponding control and/or regulation of the filling-product stream such that, in this way, matching of the filling-product flow flowing into the container can be achieved in a manner dependent on the pressure prevailing upstream of the proportional valve.

Preferably, the proportional valve can assume more than one intermediate position and particularly preferably can perform a stepped or stepless control and/or regulation of the filling-product flow between a fully open switching position and a fully closed switching position.

Here, the proportional valve may for example be designed such that a valve cone can be lifted out of a valve seat in multiple steps or continuously and, accordingly, the cross section of the annular gap formed between the valve seat and the valve cone is varied and, by way of said cross section, the filling-product flow flowing through the proportional valve can then be varied.

Buffer-free is to be understood here as meaning that provision is made of no buffer device which allows the buffered receiving of filling product, for example during breaks in production or in the event of faults of the filling device. However, a buffer device is in particular not to be understood as meaning the provided pipelines through which the filling product flows and which are filled with the filling product either over their entire cross section or at least over a part of their cross section. Also, a ring line in a filler carousel, which provides the respective filling valves with filling product, does not constitute a buffer device according to the present understanding. Rather, a buffer device is to be understood as meaning just a buffer reservoir which is provided specifically as such and which provides a corresponding buffer volume. Accordingly, the buffer device can receive a substantial quantity of additional filling product which accumulates during breaks in production or in the event of installation faults and is not received directly by the filling device.

In a preferred embodiment, the proportional valve comprises a flow meter, or is coupled directly to a flow meter, such that regulation of the filling-product volume flow which passes through the proportional valve can be regulated directly by means of regulation electronics at the proportional valve itself. It is thus possible, in a simple manner, to achieve filling of the respective container to be filled on the filler carousel by means of a corresponding volume flow specification or a predefined volume flow profile independently of the pressure of the filling product that prevails upstream of the proportional valve.

Furthermore, the described embodiment of the device with a buffer-free transfer of the filling product from the sterile tank to the proportional valve makes it possible to dispense with the filling-product boiler at the filling device itself. Accordingly, it is possible here to do away with the filling-product boiler. Thus, on the one hand, the investment costs can be reduced, and on the other hand, owing to the reduced mass of the filler carousel, the operating costs can be reduced since both drive energy, owing to the smaller mass to be moved, and cleaning costs, owing to the redundant cleaning of a filling-product boiler on the filler carousel, can be done away with here.

Furthermore, it is not necessary to provide a regulation valve for filling the filling-product boiler on the filler carousel since the filling level in the filling-product boiler, which is not present, accordingly no longer has to be set or regulated. Rather, by means of the proportional valve, response to the different filling levels or pressures within the sterile tank is possible such that reliable filling of the container to be filled with the filling product is made possible.

The proportional valve is capable in particular of responding to varying filling heights within the sterile tank, which arise due to different receiving volumes at the filling device itself. The different filling heights give rise to different pressures upstream of the proportional valve which, for a constant cross section of the annular gap of a filling valve, would lead to different filling-product flows. By means of the proportional valve, the cross section can be accordingly adjusted such that a desired filling-product flow or volume flow can be achieved or maintained.

It is advantageous in particular if the sterilization device, and consequently a short-time heating installation, is operated continuously so as to be able to maintain a predefined time of action of the heat on the filling product and, at the same time, to be able to accommodate or buffer receiving variations of the filler carousel, for example in the event of the occurrence of production faults, by means of the sterile tank.

Provided between the sterile tank and the proportional valve is preferably a rotary distributor for transferring the sterilized filling product to a filler carousel of the filling device, which filler carousel bears the proportional valve. It is then particularly preferably the case that only pipelines are provided between the rotary distributor and the proportional valve.

In this way, a particularly simple construction of the filler carousel can be achieved and a filler boiler can be dispensed with. It is thus possible for the mass of the filler carousel to be kept relatively low and for the device to be of more compact design overall.

In a particularly preferred configuration, the sterile tank in a filling-product bottling installation is positioned in a stationary manner above the filler carousel, so that the sterilization device is able to introduce the sterilized filling product into the sterile tank above the filler carousel. The filling product then flows from the sterile tank directly to the filler carousel via the rotary distributor. It is thus possible for the lengths of the line paths to be reduced, which results in further reduced investment costs and further reduced operating costs owing to the reduction in surfaces of the device that are in contact with the product and are to be cleaned or to be disinfected and/or to be sterilized.

Owing to the possible reduction in the length of the line paths to be used, it is furthermore possible for the media supplies used for the sterilization device and in particular the short-time heating means, for example nitrogen, $CO_2$, compressed air, steam, and cleaning or sterilization media, likewise to be used in the filling device and in particular on the filler carousel. In this way, the dual provision known from the prior art of the respective media can be reduced or a dual provision can be dispensed with entirely.

The possibility of the shared use of media also results from the fact that, in the sterilization device and the filling device, the same pressure conditions can prevail and, owing to the use of the proportional valve, a reliable filling result can still be achieved.

Furthermore, the sterile tank and/or the sterilization device may be included in the cleaning and/or disinfection and/or sterilization process of the entire filling system, and so here, a time-efficient and resource-conserving cleaning, disinfection and sterilization is able to be carried out and use may be made of the corresponding cleaning and/or disinfection and/or sterilization media for the whole device.

Preferably, the sterilization device comprises a heat exchanger for heating the filling product and is particularly preferably designed as a short-time heating device.

Instead of the thermal sterilization device mentioned, it is also possible for provision to be made of some other sterilization device, for example for carrying out some other physical sterilization process, for example by means of UV irradiation or plasma treatment.

Preferably, the sterile tank is the only buffer device in the device. Thus, via a single buffer device, response to the different supply quantities of the filling product to be sterilized and to the different removal quantities of the filling device is possible and, via a compact installation construction, reliable filling of the containers to be filled with the then sterilized filling product can be achieved.

In order to achieve filling of the containers to be filled with a carbonated, sterilized filling product, a pressurizing gas is preferably transferred to the filling device from the sterile tank in order to prepressurize by way of the pressurizing gas the containers to be filled, wherein the pressurizing gas is preferably transferred via a rotary distributor to a filler carousel of the filling device, which filler carousel bears the proportional valve.

It is consequently possible for a shared use of the pressurizing gas or the corresponding medium both in the sterilization device and in the filling device to be achieved.

Preferably, a cleaning device with a cleaning-media supply is provided, by means of which cleaning device a cleaning medium is supplied both to the sterile tank and to the filling device, preferably to those paths of the filling device in contact with the product. In this way, by means of a shared use of the cleaning medium and in particular also of a disinfection medium and/or sterilization medium, it is possible for cleaning and/or disinfection and/or sterilization of the device to be achieved for the purpose of preparing the device for production operation.

The cleaning device is particularly preferably designed to supply the cleaning medium additionally to a heat exchanger of the sterilization device. An efficient use of the cleaning medium is thus made possible to an even further extent.

In an advantageous refinement, the filling device is accommodated in an isolator, and the cleaning device is designed to use the cleaning medium additionally for cleaning the isolator too.

During the cleaning and/or disinfection and/or sterilization process of the device, the cleaning of the filling line and the filling valves from the sterile tank, which is preferably arranged above the filler carousel, is realized at the same time as the cleaning of the filling line and the filling valves. The cleaning medium can then be passed via a CIP return means, for example a CIP return means from the isolator, in which the filler carousel is arranged, back into the sterile tank, wherein a cleaning-media preparation means is preferably arranged in an interposed manner. Accordingly, it is possible here to achieve a circular passage of the cleaning, disinfection or sterilization media, in order, in this way, for a closed cleaning, disinfection or sterilization circuit to be provided, in which circuit both the filling device and the sterilization device and also the sterile tank are cleaned, disinfected and sterilized in an efficient manner.

Particularly in the case of the bottling of carbonated filling products, it is furthermore possible for a shared media supply both to the sterile tank and via a rotary distributor to the filler carousel to take place, wherein accordingly, the respective media and in particular the pressurizing gas need to be provided only once and not, as is known from the prior art, separately for the sterilization device and the filling device in each case. Accordingly, the pressure which prevails in the sterilization device and the sterile tank in order to prevent outgassing of the $CO_2$ in the filling product may also be used for prepressurizing the respective container to be filled in order for it to be possible to fill the prepressurized container accordingly, and so efficient bottling, with a reduced tendency for foaming, of the filling product in the respective container is made possible in this way.

Preferably, subsequent relieving of pressure to ambient pressure of the container which is prepressurized and then filled with the sterilized and carbonated filling product likewise takes place via a rotary distributor, so that targeted removal of the pressurizing gas, and in particular the $CO_2$, from the filling device can be achieved.

A further advantageous effect of the use of the proportional valve is that, accordingly, bottling is possible also under an increased pressure and the filling product which is present upstream of the proportional valve can be present under an increased pressure. Accordingly, it is possible for the filling product to be pushed through the proportional valve under increased pressure too, and in this way, for an increased volume flow and thus quicker filling with the filling product of the containers to be filled to be achieved. Consequently, for identical installation dimensioning, for example with respect to the filler diameter, an increased throughput can be achieved or, for a predefined throughput, the entire installation can be of more compact design.

The elimination of components, for example the elimination of the filling product boiler on the rotating part of the filler, and the corresponding omission of additional media supplies allows the level of failure safety of the entire installation to be further increased. The control of the sterile tank or of the filling height thereof or the control of the sterilization device can furthermore be performed by the filling-product bottling installation and in particular the filler, and so, at this point, coordination between two previously separate installation parts is eliminated and, in this way, a more efficient installation construction can be realized.

Preferably, the proportional valves, which are designed as a filling valve, are the only product-regulating valves in the device. For the respective section between the sterile tank and the filling valve, there is consequently only a single valve by way of which the product flow can be regulated, namely the proportional valve. Consequently, firstly clear and simple regulation of the product flow can be achieved since it is not necessary to consider interactions between regulating valves which are arranged next to one another. Secondly, the device can altogether be of a more simple design with fewer components, this having an advantageous effect on the costs and the cleaning capacity.

Preferably, the sterile tank is arranged in a plane situated above the filler plane formed by the proportional valves. Consequently, firstly a relatively short path of the filling-product line can be achieved, with the result that the investment costs and the cleaning costs can be reduced. Secondly, residual emptying of the sterile tank can be reliably achieved in that outflow from the sterile tank is possible via the proportional valves, which are accordingly situated beneath the sterile tank.

BRIEF DESCRIPTION OF THE FIGURES

Preferred further embodiments of the invention will be discussed in more detail on the basis of the following description of the Figures, in which.

DETAILED DESCRIPTION OF PREFERRED EXEMPLARY EMBODIMENTS

Preferred exemplary embodiments will be described below on the basis of the figures. Here, identical elements, similar elements or elements of identical action are denoted by the same reference signs in the various figures, and in order to avoid redundancies, a repeated description of said elements will, in part, be omitted.

Figure 1:
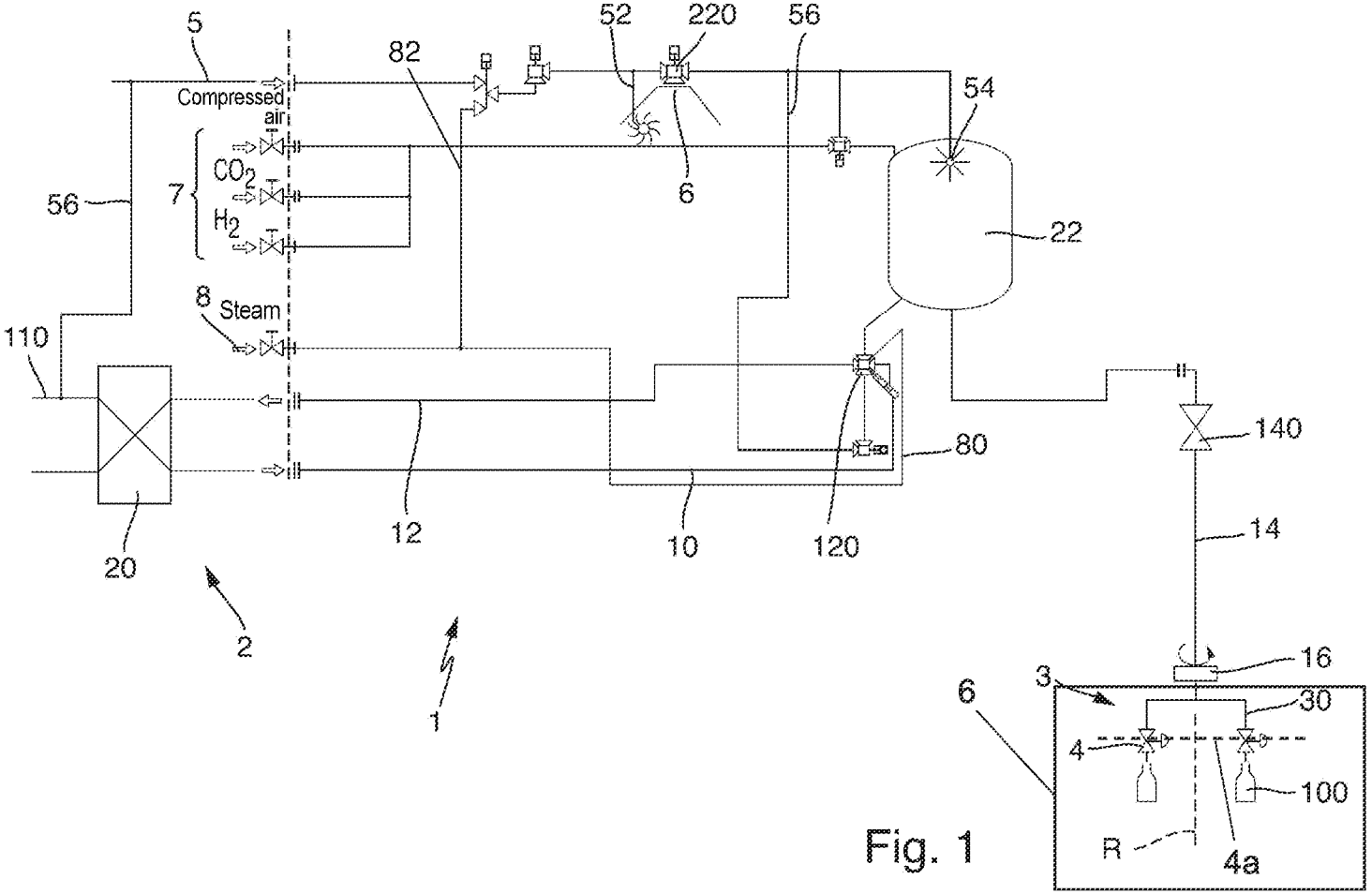
FIG. 1 shows a schematic illustration of the proposed device for bottling non-carbonated filling products.

FIG. 1 schematically shows a device 1 for filling schematically illustrated containers 100 with a sterilized filling product. The device 1 comprises a sterilization device 2 and a filling device 3. The sterilization device 2 has a heat exchanger 20 in which filling product supplied via a filling-product supply line 110 is heated to a predefined sterilization temperature and, in this way, is sterilized.

After the treatment in the heat exchanger 20 of the sterilization device 2, the sterilized filling product is fed via a sterile-product supply line 10 to a transfer valve 120 and is transferred from the transfer valve 120 to a sterile tank 22.

The filling-product flow supplied via the filling-product supply line 110 is accordingly thermally sterilized in the heat exchanger 20 of the sterilization device 2 and, when the filling-product flow is supplied via the sterile-product supply line 10 and the transfer valve 120, can then be buffered in the sterile tank 22. By means of the sterile tank 22, it is accordingly possible to compensate for variations in the supplied quantity of filling product via the sterile-product supply line 10 and variations in the removal of the sterile filling product by the filling device 3.

Instead of the thermal sterilization device shown here with the heat exchanger 20, it is also possible for provision to be made of some other sterilization device, for example for carrying out some other physical sterilization process, for example by means of UV irradiation or plasma treatment.

The sterile filling product is then supplied to the filling device 3 from the sterile tank 22 via a filling-product line 14. The filling device 3 comprises a filler carousel 30 which is rotatable about an axis of rotation R. The transfer of the sterile filling product from the stationary filling-product line 14 to the rotating filler carousel 30 takes place via a rotary distributor 16 which, in a manner known per se, passes the filling product from a stationary part to a rotating part.

At the filler carousel 30 of the filling device 3, provision is made on the circumference thereof of a plurality of filling valves, which each introduce into the respective containers 100 to be filled which are assigned to the respective filling valve the filling-product flow from the filling-product flow supplied via the rotary distributor 16. The filling valves are each designed as a proportional valve 4, with the result that the filling-product flow flowing into the container 100 to be filled can be controlled and/or regulated.

The proportional valve 4 accordingly makes it possible not only for the filling-product flow which flows into the container 100 to be filled to be switched between an open state and a closed state, but also for further filling-product flows to be settable by means of the proportional valve too. It is possible in particular for the filling-product flow to be varied between zero and full flow, which corresponds to a fully open filling valve 4, preferably substantially in a stepless manner or at least in a plurality of steps.

Preferably, the proportional valve 4 comprises not only the possibility for variation of the valve position, for example through variation of the annular gap between a valve seat and a valve cone, but also a volume flow sensor, with the result that simple activation of the proportional valve 4 can be realized such that a desired volume flow is set and is then automatically adjusted in a regulated manner by means of activation electronics of the proportional valve 4.

Accordingly, as can be seen from FIG. 1, filling of containers 100 to be filled is possible independently of the respective filling level or filling state of the sterile tank 22 or independently of which pressure prevails in the filling-product line 14, which guides the filling product from the sterile tank 22 to the rotary distributor 16. It is accordingly possible by means of the proportional valve 4 for the pressure prevailing in the filling-product line 14 to be compensated and for a desired filling quantity of sterile filling product in the container 100 to be achieved.

In order to achieve a short length of the filling-product line 14 and reliable flowing-out from the sterile tank 22, the sterile tank 22 is preferably situated above the filler plane 4*a*, which is formed by the proportional valves 4. Consequently, the outflow from the sterile tank 22 into the filling-product line 14 also lies above the filler plane 4*a* formed by the proportional valves 4. Here, the sterile tank 22 is particularly preferably arranged on a platform above the filler carousel 30.

Provided for a cleaning process of the device 1 is a cleaning device which comprises a cleaning-media supply 5 which may also serve for the cleaning, disinfection or sterilization of an isolator 6 in which at least the filler carousel 30 of the filling device 3 may be arranged. For this purpose, provision is made of spray nozzles 52 at the isolator 6 or in the isolator 6, by means of which spray nozzles a cleaning, disinfection or sterilization medium can be applied to the surfaces to be treated of the isolator 6.

The cleaning and/or disinfection and/or sterilization medium supplied via the cleaning-media supply 5 can furthermore be used for cleaning the sterile tank 22 via a sterile-tank cleaning nozzle 54. The respective cleaning, disinfection and/or sterilization medium can then be passed from the sterile tank 22 to the filler carousel 30 via the filling-product line 14 and the rotary distributor 16 in order then to exit at the filling valves, and in particular the proportional valves 4, preferably into the isolator 6. It is accordingly possible for cleaning, disinfection or sterilization of the regions in contact with the product, and in particular of the sterile tank 22, the filling-product line 14, the rotary distributor 16, those regions of the filler 3 in contact with the filling product and the filling valves 4, to be achieved by means of a single cleaning-media supply 5.

It is possible for the cleaning device to be provided in particular in the form of a CIP (cleaning in place) means, in the case of which all the components of the device 1 can remain installed in the operationally ready state during the cleaning, disinfection or sterilization and it is not necessary for the device 1 to be dismantled for the cleaning, disinfection or sterilization. The cleaning, disinfection and/or sterilization media are in this case supplied in the form already mentioned and can then be supplied to the cleaning-media supply 5 again via a CIP return means and a media preparation means.

It is furthermore also possible to clean the heat exchanger 20 of the sterilization device 2 via a cleaning-media supply line 56, and so, here too, the cleaning, disinfection and/or sterilization medium can flow through the regions in contact with the product.

As an alternative to the illustrated embodiment, in which cleaning, disinfection and/or sterilization media are provided via the cleaning-media supply line 56 from the cleaning-media supply 5 to the sterilization device 2, the cleaning, disinfection and/or sterilization media may, in a manner not illustrated, equally be provided via the filling-product supply line 110 at the sterilization device 2 and fed via a cleaning-media supply line 56 into the cleaning-media supply 5. In this way, the cleaning, disinfection and/or sterilization media may also for example already have cleaned a product preparation installation arranged upstream. Moreover, it is possible to do away with the separate media supply to the cleaning-media supply 5.

A separation of the sterile-product supply line 10, coming from the heat exchanger 20, and the sterile tank 22 may be realized at the transfer valve 120. It is accordingly possible for the sterilization device 2 and in particular the heat exchanger 20 to already be cleaned, wherein the cleaning, disinfection and/or sterilization medium is then returned via a sterile-product return line 12, while bottling via the proportional valves 4 of the sterile filling product buffered in the sterile tank 22 is also carried out simultaneously. The sterile separation between the sterile-product supply line 10 and the sterile tank 22 is supported at the transfer valve 120 by a steam barrier, which obtains the required steam via a steam supply 8 and a steam-barrier line 80. It is thus possible for the filling process from the sterile tank 22 and the cleaning of the sterilization device 2 to be decoupled from one another in terms of time.

The steam provided via the steam supply 8 may also be used for subjecting the remaining installation components to it for the purpose of the sterilization thereof, for example through supply, by means of a sterile-steam line 82, to the installation components to be sterilized.

In order, in the event of a fault at the filling device 3, which for example necessitates replacement of a proportional valve 4, not to have to dispose of the sterile filling product still present in the sterile tank 22, provision is made in the filling-product line 14 of a shut-off valve 140 by which the sterile tank 22 can be separated from the filling device 3.

The device 1 shown in FIG. 1 serves in particular for bottling still filling products, that is to say in particular those products which are not carbonated. Here, prepressurization of the containers 100 to be filled is not necessary and, both in the sterile tank 22 and in the filling-product line 14, the rotary distributor and those regions of the filling-product supply which are situated upstream of the proportional valve 4, it is unimportant which pressure prevails. In particular, no minimum pressure has to be maintained in the sterilization device 2, which minimum pressure would be necessary in the case of the bottling of carbonated filling products in order to prevent or to reduce outgassing or release of the $CO_2$.

The sterile tank 22 can "breathe" into the isolator 6 via a breather valve 220, in order substantially to provide a constant atmospheric pressure in the head space of the sterile tank 22 even if different filling levels are achieved in the sterile tank 22.

Figure 2:
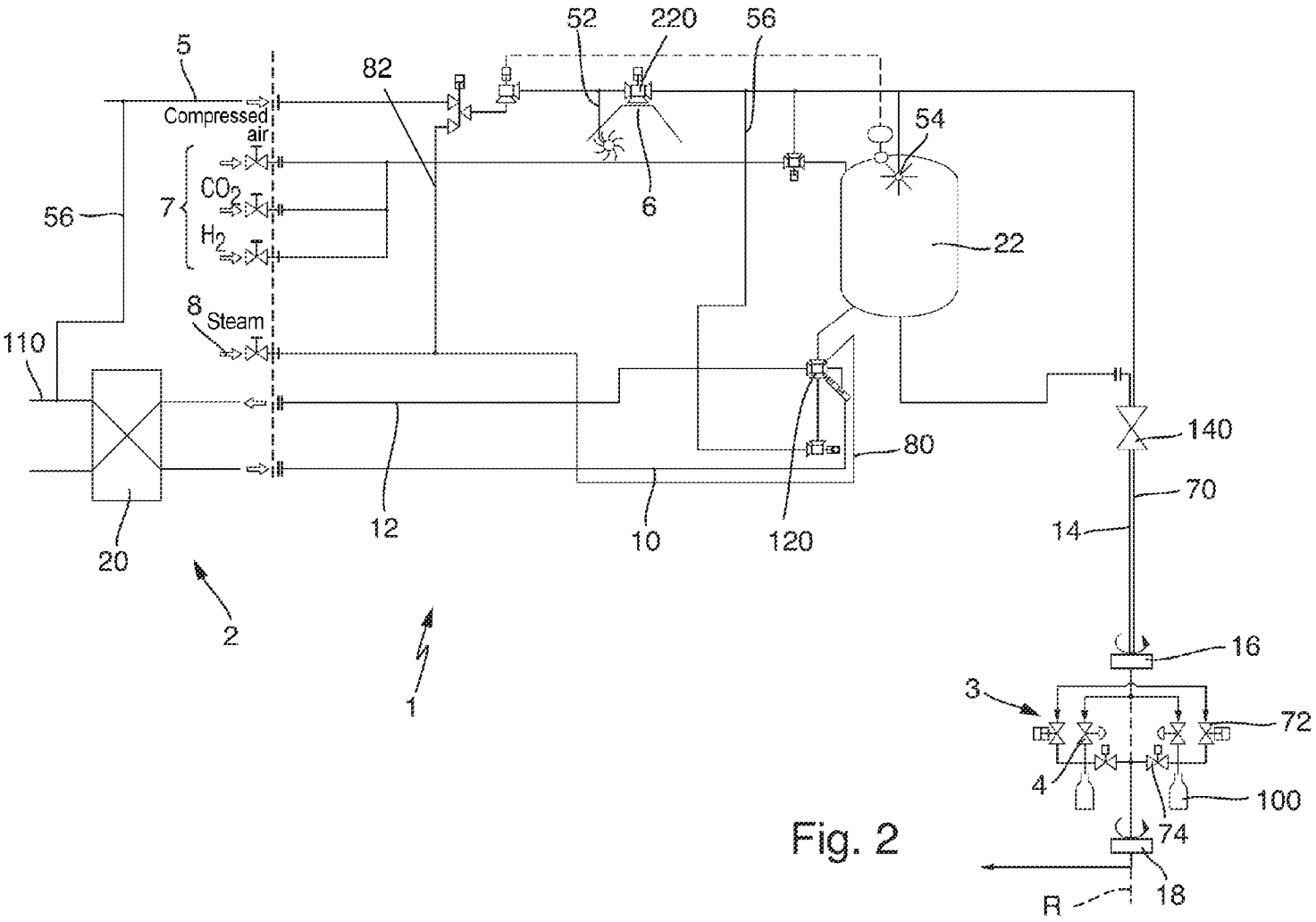
FIG. 2 shows a schematic illustration of the proposed device for bottling carbonated filling products.

FIG. 2 then shows a variant of the device 1, which may also be used for the bottling of carbonated sterile filling products. Here, it is important that the filling product, which is supplied via the filling-product supply line 110 and which is supplied to the heat exchanger 20 of the sterilization device 2, is at all times under a pressure which largely prevents release or outgassing of the $CO_2$ from the carbonated filling product. Specifically, within the heat exchanger 20 of the sterilization device 2, this outgassing would lead to foam forming within the heat exchanger 20, with the result that it would not be possible to ensure reliable heating of the filling product and thus the attainment of microbiological safety. Accordingly, it is necessary, both in the heat exchanger 20 and in the sterile tank 22 situated downstream, to regulate the pressure to a level which is above the saturation pressure for the $CO_2$ in the filling product.

In order to make it possible here for the containers to be filled to be prepressurized by way of the pressurizing gas in order that the filling product can be introduced into the prepressurized container 100 so as to avoid excessive release of the $CO_2$ during the filling process, a pressurizing gas line 70, which can be fed for example with pressurizing gas from the head space of the sterile tank 22, is provided in addition to the filling-product line 14 from the sterile tank 22. The head space of the sterile tank 22 is subjected for example to compressed air, nitrogen and/or $CO_2$ via a pressurizing-gas supply 7 in order to provide corresponding prepressurization.

Alternatively, the pressurizing gas for prepressurizing the containers 100 to be filled may also be provided directly from a pressurizing-gas supply 7. Preferably, said pressurizing-gas supply 7 is also the pressurizing-gas supply 7 which provides the sterile tank 22 with a supply. In this way, it is possible to do away with additional valves and similar fittings and the construction of the installation is simplified.

Both the filling-product line 14 and the pressurizing-gas line 70 are passed to the rotating part of the filler 3 via the rotary distributor 16 such that both bottling of the sterile filling product by means of the proportional valve 4 and prepressurization carried out beforehand of the containers 100 via a corresponding pressurizing-gas valve 72 at the rotating part of the filler 3 by way of the pressurizing gas supplied via the pressurizing-gas line 70 can be carried out.

After the filling process has been carried out, the pressure prevailing in the head space of the then filled container 100 has to be relieved in a controlled manner to ambient pressure. Provided for this purpose is a further rotary distributor 18, via which pressure relief of the filled container 100 can be achieved via in each case one corresponding relief valve 74, wherein the gas mixture then transferred via the rotary distributor 18, and possibly filling-product residues in the form of foam, can be sent on for controlled disposal. Preferably, a relief line (not shown) following the rotary distributor 18 opens into a sterile region, particularly preferably the sterile isolator 6. In this way, it is not possible for contaminants or bacteria to be introduced into the filling valve rearwards through this line path and the microbiological safety is increased.

During the cleaning process, it is again possible for cleaning medium to be applied via the cleaning-media supply 50 to the isolator nozzles 52, and to the sterile tank 22 via the sterile-tank nozzle 54, and also via the cleaning-media supply line 56 to the heat exchanger 20, with the corresponding cleaning, disinfection and/or sterilization medium.

It is furthermore possible to treat not only the filling-product line 14, but also the pressurizing-gas line 70, the pressurizing-gas valves 72 and the relief valves 74, with the rotary distributor 18 included, in order, in this way, to achieve complete cleaning, disinfection and/or sterilization both of the isolator interior 6 and of all the paths in contact with the filling product and also of the pressurizing-gas paths.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

Where applicable, all the individual features presented in the exemplary embodiments may be combined with one another and/or interchanged without departing from the scope of the invention.

The invention claimed is:

1. A device for filling a container with a sterilized filling product, the device comprising:

a sterilization device for sterilizing a filling product;

a sterile tank connected to the sterilization device, the sterile tank configured for buffered receiving of the filling product sterilized in the sterilization device and the sterile tank is the only buffer device in the device; and a filling device connected to the sterile tank, the filling device including a filling valve for the filling of the container to be filled, wherein the filling valve is a proportional valve configured to control filling-product flow of the filling product into the container to be filled and the proportional valve is connected in a buffer-free manner to the sterile tank.

2. The device of claim 1, further comprising a rotary distributor provided between the sterile tank and the proportional valve, the rotary distributor configured to transfer the sterilized filling product to a filler carousel of the filling device, the filler carousel including the proportional valve.

3. The device of claim 2, wherein only pipelines are provided between the rotary distributor and the proportional valve.

4. The device of claim 2, wherein the filling device is configured to pre-pressurize the container to be filled with a pressurizing gas obtained from the sterile tank.

5. The device of claim 4, wherein the rotary distributor is further configured to transfer the pressurizing gas to the filler carousel of the filling device from the sterile tank.

6. The device of claim 5, wherein the proportional valve is the only product-regulating valve in the device.

7. The device of claim 6, wherein the sterile tank is arranged in a plane situated above a filler plane formed by the proportional valve.

8. The device of claim 2, further comprising a cleaning device with a cleaning-media supply to supply a cleaning medium, the cleaning device configured to supply the cleaning medium to both to the sterile tank and to the filling device.

9. The device of claim 1, wherein the sterilization device comprises a heat exchanger for heating the filling product to sterilize the filling product.

10. The device of claim 1, wherein the filling device is configured to pre-pressurize the container to be filled with a pressurizing gas obtained from the sterile tank.

11. The device of claim 10, wherein the pressurizing gas is transferred via a rotary distributor to a filler carousel of the filling device from the sterile tank, the filler carousel including the proportional valve.

12. The device of claim 1, further comprising a cleaning device with a cleaning-media supply to supply a cleaning medium, the cleaning device configured to supply the cleaning medium to both the sterile tank and the filling device.

13. The device of claim 12, wherein the cleaning device is configured to supply the cleaning medium to a heat exchanger of the sterilization device.

14. The device of claim 12, wherein the filling device is accommodated in an isolator, and the cleaning device is configured to use the cleaning medium for cleaning the isolator.

15. The device of claim 12, wherein the cleaning medium is supplied to paths of the filling device in contact with the filling product.

16. The device of claim 1, wherein the proportional valve is the only product-regulating valves in the device.

17. The device of claim 1, wherein the sterile tank is arranged in a plane situated above a filler plane formed by the proportional valve.

18. The device of claim 1, wherein the container is a beverage container, the filling product is a sterilized beverage, and the device is part of a beverage bottling installation.

* * * * *